US007927435B2

(12) United States Patent
Eucken

(10) Patent No.: US 7,927,435 B2
(45) **Date of Patent: *Apr. 19, 2011**

(54) ZIRCONIUM STRIP MATERIAL AND PROCESS FOR MAKING SAME

(75) Inventor: Craig M. Eucken, Scio, OR (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/570,221

(22) Filed: Sep. 30, 2009

(65) Prior Publication Data

US 2010/0018616 A1 Jan. 28, 2010

Related U.S. Application Data

(62) Division of application No. 11/221,015, filed on Sep. 7, 2005, now Pat. No. 7,625,453.

(51) Int. Cl.
*C22C 16/00* (2006.01)

(52) U.S. Cl. ..... 148/668; 148/421; 148/672

(58) Field of Classification Search ..... 148/421, 148/668, 672
See application file for complete search history.

(56) References Cited

U.S. PATENT DOCUMENTS 5,076,488 A * 12/1991 Graham ..... 148/519
7,625,453 B2 * 12/2009 Eucken ..... 148/421

OTHER PUBLICATIONS

R. K. Shah and A.C. Mueller, "Heat Exchange", Ullmann's Encylcopedia of Industrial Chemistry, online: Jun. 15, 2000, 10 pages total.*

M.L. Picklesimer. "A preliminary examination of the formation and utilization of texture and anisotrophy in Zircaloy-2", Castlewood Pleasanton, CA, Nov. 12-14, 1962.*

R. Nielsen, "Zirconium and Zirconium Compounds", Ullmann's Encyclopedia of Industrial Chemistry, online Jun. 15, 2000, 29 pages total.*

* cited by examiner

*Primary Examiner* — George Wyszomierski
*Assistant Examiner* — Mark L Shevin
(74) *Attorney, Agent, or Firm* — K & L Gates LLP; Patrick J. Viccaro; John E. Grosselin, III

(57) ABSTRACT

Methods for producing zirconium strips that demonstrate improved formability are disclosed. The zirconium strips of the present disclosure have a purity and crystalline microstructure suitable for improved formability, for example, in the manufacture of certain articles such as panels for plate heat exchangers and high performance tower packing components. Other embodiments disclosed herein relate to formed substantially pure zirconium strip, articles of manufacture produced from the substantially pure zirconium strip, and methods for making the articles of manufacture.

16 Claims, 4 Drawing Sheets

ZIRCONIUM STRIP MATERIAL AND PROCESS FOR MAKING SAME

CROSS-REFERENCE TO RELATED APPLICATIONS

This is a divisional of co-pending U.S. patent application Ser. No. 11/221,015, filed Sep. 7, 2005.

BACKGROUND

Certain non-limiting embodiments of the present disclosure relate to methods for producing substantially pure zirconium strips for forming various articles of manufacture such as panels for plate heat exchangers and high performance tower packing components. The zirconium strip of the present disclosure has a purity and crystalline structure that allows deformation as required in the formation of various articles of manufacture. Other non-limiting embodiments relate to methods for processing the highly purified zirconium into strips suitable for forming articles of manufacture, such as panels for plate heat exchangers and high performance tower packing.

DESCRIPTION OF RELATED ART

Heat exchangers, such as, for example, fin and tube, shell and tube, and plate heat exchangers, are used to recover or dissipate heat energy, for example, heat energy produced during industrial processes. Heat energy is typically transferred from a hot air or fluid flow to a cold air or fluid flow by conduction through barriers separating the hot air or fluid from the cold air or fluid.

Plate heat exchangers are typically more efficient than fin and tube or shell and tube type heat exchangers. It is not uncommon for plate heat exchangers to have overall heat-transfer coefficients that are three to four times those found in shell and tube heat exchangers of similar size. Thus, plate heat exchangers can typically be smaller, less expensive, and use less coolant, such as water, than other types of heat exchangers.

Plate heat exchangers consist of parallel or "stacked" corrugated plates or panels that separate the hot fluid and the cold fluid. As used herein, the terms "plate" and "panel" mean thin, rigid, heat conducting metallic or polymeric material structures, such as, for example, those that separate the hot and cold fluids in a plate heat exchanger. The plates are compressed together in a rigid frame to create an arrangement of parallel flow channels. The hot and cold fluids flow alternately between each of the plates, typically with a counter-current flow. Each plate flow channel is sealed with a gasket, a weld, or an alternating combination of the two, depending on the liquid or gas passing therethrough and whether subsequent separation of the plates is desired, for example, for inspection or cleaning purposes. The plates typically contain corrugations or baffles. As used herein, the terms "corrugation" and "baffles" mean the grooves, channels, waves, or indentations in the plate. The corrugations or baffles direct the flow of the fluid/gas between the plates and may increase turbulence within the flow. The baffles also serve to increase the surface area of the plate in contact with the fluid/gas, thereby providing for an increased heat transfer area and optimized fluid/gas distribution.

Plate heat exchangers may be either single-phase, containing either hot and cold liquid or hot and cold gas, or two-phase, containing a gas and a liquid and thereby serving as a condenser, evaporator, or reboiler.

The plates or panels of plate heat exchangers are typically formed from a strip of a material that is readily formable and resistant to corrosion, such as stainless steel or certain titanium alloys. Forming panels for plate heat exchangers typically requires a high degree of deformability, for example, to form the corrugations or baffles in the panels. For example, in certain applications, the panels of plate heat exchangers may comprise corrugations consisting of parallel chevron shaped indentations in the panel having a depth of up to about 8 millimeters (mm) and a bend radius at the peak of the corrugation having a radius of from 5 to 10 times the thickness of the panel material. The panel indentations may be formed on strips of a suitable metal or alloy by a conventional forming process, such as, for example, a stamping process, a pressing process, or a hydrostatic forming process.

Packed towers are utilized in a variety of industries for a variety of industrial processes, such as separation of liquids and gases and for scrubbing of gases. Packed towers are packed with a variety of tower packing media. The tower packing provides a surface for contact and mass transfer between the liquid streams and vapor streams for the purpose of distillation, rectification, fractionation, stripping, splitting, absorption, desorption, cooling, heating, or similar unit operations.

Tower packing is designed to provide ample opportunity for the liquid and vapor to come into intimate and extended contact/reaction with one another so that mass and energy exchange between the vapor and liquid may occur. These exchanges are strongly dependent on the area of contact between the vapor and the liquid. The structure and shape of the tower packing component may have a significant effect on these exchanges. Consequently, a variety of tower packing components have been developed that maximize contact between the vapor and the liquid. Non-limiting examples of tower packing components include random packing components, such as saddle rings, rasching rings, pall-type rings; along with structured tower packing components, such as metal corrugated plate tower packing and gauze-type structured packing.

Tower packing components may be made from ceramic, plastic, or metal (i.e, a metallic alloy). Metal tower packing components may be formed from metal strip material. The metal strip material must be formed into the sometimes complex shapes associated with the particular packing component. Metal is generally effective as tower packing material due to its typically high heat transfer capability. Certain metals, however, may be ineffective when the particular industrial process involves a corrosive gas or liquid and/or conditions promoting corrosion. In those circumstances it is important that the material from which the tower packing components are fabricated has a high degree of corrosion resistance.

Zirconium alloys, such as Zircaloy-2, Zircaloy-4, Zirconium-2.5% Niobium, and Zirconium-1% Niobium have been used in nuclear applications, for example as spacer grids for nuclear fuel assemblies. Producing these spacer grids commonly involves stamping various "s-bends" and dimple features onto strips of the selected alloy. Due to the limited formability of these zirconium alloys, the bend radii employed in manufacturing the spacer grids from strips have been limited to large values, typically greater than three times the material thickness in the case of s-bends, while the forming of dimples in the strips has required the use of both large radii and shallow forming depths to preclude strip cracking. Thus, there is an advantage to increasing the formability of zirconium and zirconium alloys. Improved formability of zirconium alloy strip may be achieved by controlling the alloy composition. Microstructure also is known to effect formability of zirconium alloys and can be influenced during processing of the alloy into strip form.

Processing parameters used with zirconium alloys are generally defined by what is practical. For example, hot rolling temperatures used in standard processing are based mostly on equipment limitations and the desire for process efficiency. To optimize rolling efficiency, the highest practical hot rolling temperature consistent with the desired homogeneous microstructure is typically chosen. Likewise, high annealing temperatures are generally chosen to optimize process throughput while maintaining alloy homogeneity. For example, in certain processes, vacuum annealing at a higher temperature, such as 780° C. (1436° F.), may be preferred over annealing at a relatively low temperature, such as less than 600° C. (1112° F.), because the time required to soften the alloy is reduced if higher temperatures are used, and increased throughput thereby results.

Texture and anisotropy may have a significant affect on the formability of zirconium alloys. See, for example, M. L. Picklesimer, "*A Preliminary Examination of the Formation and Utilization of Texture and Anisotropy in Zircaloy*-2," in Proceedings of the USAEC Symposium on Zirconium Alloy Development, Pleasanton, Calif., Nov. 12-14, 1962, pp. 13-0 to 13-35, the disclosure of which is incorporated herein by reference. Applications of texture control in forming operations of zirconium alloys are discussed. Picklesimer notes that in bending operations of certain zirconium alloys, if the basal poles of the hexagonal close packed (hcp) crystals are oriented parallel to the bend axis, all of the strain associated with the bending can be accomplished entirely by slip, and the bending forces will be low and the available ductility will be high.

More specifically, when bending sheet stock, such as strips of zirconium alloy, to form sharp corners, as the stock is bent the outer surface is placed in tension and the inner surface in compression. The ductility of the material limits the amount of bending that can be accommodated. If the ductility is small, the bend radius must be large or the material will crack during bending. If the basal poles are oriented in the direction of the bend radius (see FIG. 3), all of the tensile strain must occur by twinning. The tensile stress in the surface must be high if the necessary plastic strain is to occur. At room temperature, the ductility under these conditions is limited. Thus, the material will crack during bending if the bend radius is small.

The corrosion resistance of zirconium in various corrosive media has long been recognized. Zirconium is highly resistant to corrosive attack in most mineral and organic acids, strong alkalis, saline solutions, and certain molten salts. The corrosion resistance of zirconium is a result of its high affinity for oxygen. When zirconium is exposed to an oxygen-containing environment, an adherent, protective oxide film forms on its surface. The film is formed spontaneously in air or water at ambient temperature and is self-healing. The film protects the base metal from chemical attack at temperatures up to about 300° C. (572° F.).

Zirconium is fabricated into various articles, such as, for example, piping, vessels, and tub and shell heat exchangers in chemical processing. The use of zirconium in more efficient plate heat exchangers has not been achieved because of, for example, the limited ductility or formability of zirconium strip compared to conventional materials such as stainless steel, copper alloys, and nickel-base alloys. Commercially available zirconium strip may be processed to include "bathtub" shaped indentations having a depth of about 1 to 1.5 mm. However, attempts to form deeper indentations in commercially available zirconium or zirconium alloy strip, such as the parallel chevron shaped indentations formed in panels for plate heat exchangers, result in cracking of the material. In addition, zirconium strip has not typically been used in the manufacture of tower packing components due to the high degree of deformation necessary to shape the components. Such high deformations would also result in cracking of the metal strip during the shaping process.

Commercially pure ("CP") zirconium, designated as grade 702, typically includes impurities within the range of 130 ppm to 170 ppm of carbon, 20 ppm to 65 ppm of nitrogen, less than 50 ppm of hydrogen, 1300 ppm to 1500 ppm of oxygen, 500 ppm to 1000 ppm of iron, 70 ppm to 150 ppm of chromium, and from about 0.5% to 1.5% of hafnium. CP zirconium may be used in applications where it is formed into large vessels or pipes of varying sizes. The pipes may be bent into β-bends for use in tube and shell heat exchangers. However, the severity of the u-bends is limited by the inherent lack of ductility of zirconium and zirconium alloys, as mentioned above.

The limited formability of zirconium is believed to be related to the crystal structure of the material, a hexagonal-close packed lattice, which has limited operating deformation systems, particularly at room temperature. These limitations make it difficult to form zirconium to the same degree as conventional alloys by means that involve deep drawing, stretching and/or pressing deformation.

Thus, it would be desirable to develop a method of producing a zirconium strip material having high corrosion resistance and high degree of ductility. High ductility would allow the strip to be formed into a variety of articles of manufacture having corrugations, dimples, and bends with small radii, formed articles that cannot be formed from conventional zirconium and zirconium alloys using conventional methods.

BRIEF SUMMARY

The various embodiments of the present disclosure are directed toward a readily formable substantially pure zirconium strip material and methods for forming the same. The substantially pure zirconium strip material may be used to form articles of manufacture, such as, for example, corrosion resistant panels for plate heat exchangers and tower packing components.

According to one non-limiting embodiment, the present disclosure provides a method of producing a deformable zirconium strip. The method comprises: heating a substantially pure zirconium article within a beta phase temperature region; beta quenching the zirconium article; forming a strip from the zirconium article by a process comprising hot working the zirconium article at a temperature of about 470° C. (878° F.) to about 700° C. (1292° F.); reducing the thickness of the strip by a process comprising a plurality of cold rolling passes with intermediate anneals between successive cold rolling passes, wherein each intermediate anneal includes heating the strip at less than about 490° C. (914° F.) for less than 10 minutes; and final annealing the strip after a final cold rolling pass, wherein the strip is heated at less than 550° C. (1022° F.) for less than 20 minutes.

Another non-limiting embodiment provides a method for producing an article of manufacture. The method comprises: heating a substantially pure zirconium article comprising less than 600 ppm oxygen, less than 200 ppm iron, less than 50 ppm carbon, less than 50 ppm silicon, less than 50 ppm niobium, and less than 100 ppm tin within a beta phase temperature region; beta quenching the zirconium article by a process comprising immersing the article in a liquid, for example, one of oil and water; forming a strip from the zirconium article by a process comprising hot working the zirconium article at a temperature of about 470° C. (878° F.) to about 700° C. (1292° F.); reducing a thickness of the strip, for example, to about 0.5 millimeters to about 0.8 millimeters, by a process comprising a plurality of cold rolling passes with intermediate anneals between successive cold rolling passes, wherein each intermediate anneal includes heating the strip at less than about 490° C. (914° F.) for less than 10 minutes; final annealing the strip after a final cold rolling pass, wherein the strip is heated at less than 550° C. (1022° F.) for less than 20 minutes; and shaping the strip into the article of manufacture by a process comprising shaping the strip on a hydraulic press, for example, at a ram speed of less than about 0.4 mm/sec.

A further non-limiting embodiment provides an article of manufacture comprising: a formed strip of a substantially pure zirconium including less than 600 ppm oxygen, less than 200 ppm iron, less than 50 ppm carbon, less than 50 ppm silicon, less than 50 ppm niobium, and less than 100 ppm tin. The article of manufacture may be, for example, a panel for a heat exchanger, such as a plate heat exchanger, or a column packing component.

Yet another non-limiting embodiments provides a formed substantially pure zirconium strip including: less than 600 ppm oxygen, less than 200 ppm iron, less than 50 ppm carbon, less than 50 ppm silicon, less than 50 ppm niobium, and less than 100 ppm tin.

DETAILED DESCRIPTION

Figure 1:
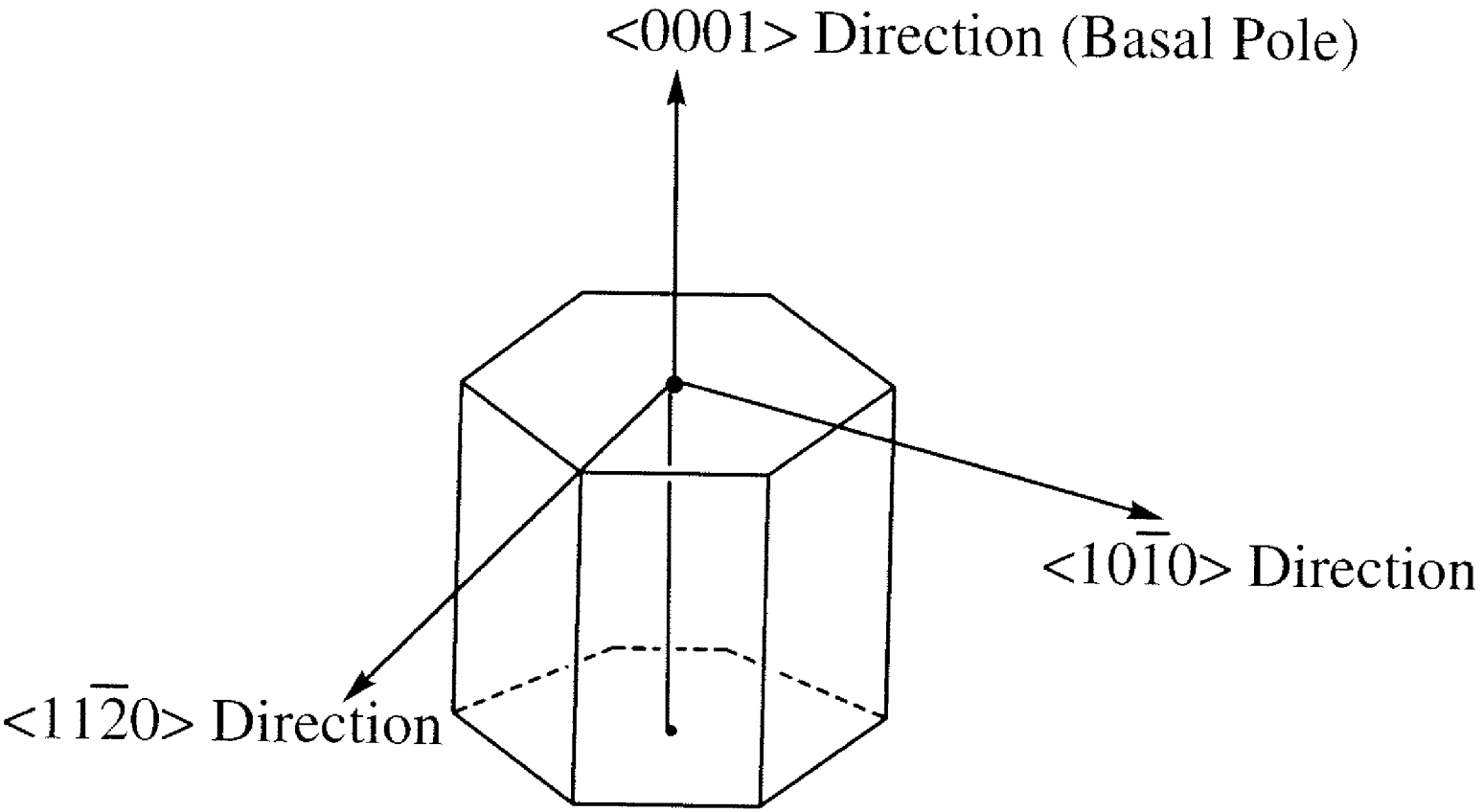
FIG. 1 illustrates the deformation systems and crystallographic planes and directions in hexagonal close packed zirconium crystals.

Certain non-limiting embodiments of the present disclosure relate to methods for producing a substantially pure zirconium strip that may be formed into an article of manufacture such as, without limitation, a panel for a plate-type heat exchanger and high performance tower packing components. As used herein, the term "strip" means a flat-rolled metal product of some maximum thickness, dependent upon the type of metal which for zirconium and its alloys may range from 0.25 mm to 3 mm, wherein the metal product is narrower in width than a sheet. The term strip shall be understood to also include portions of a strip. Other non-limiting embodiments relate to a novel method of producing an article of manufacture comprising a substantially pure zirconium strip. Still other non-limiting embodiments relate to a substantially pure zirconium strip and articles of manufacture made therefrom. Substantially pure zirconium consists essentially of zirconium metal having lower levels of impurities than CP zirconium. As used herein, the terms "impurity" or "impurities" are defined as any element other than zirconium. As used herein, the term "substantially pure zirconium" is defined as zirconium comprising greater than 99.35% zirconium and including less than 200 ppm of iron and less than 600 ppm of oxygen. While processed zirconium typically contains hafnium, the substantially pure zirconium according to certain non-limiting embodiments herein typically include hafnium levels of less than 500 ppm.

Other than the operating examples, or where otherwise indicated, all numbers expressing quantities of ingredients, processing conditions and the like used in the present specification and claims are to be understood as being modified in all instances by the term "about". Accordingly, unless indicated to the contrary, the numerical parameters set forth in the following specification and attached claims are approximations that may vary depending upon the desired properties sought to be obtained. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical values, however, inherently contain certain errors, such as, for example, equipment and/or operator error, necessarily resulting from the standard deviation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of less than or equal to 10.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Certain non-limiting embodiments of the methods and compositions of the present disclosure relate to a process that appears to be dependent upon the combined effect of each of the individual parts to achieve success in forming a zirconium strip that may be formed into articles of manufacture, such as for example, panels for plate heat exchangers and tower packing components. The process relies, in part, upon the ductility of a substantially pure zirconium and, in part, to processing according to the various embodiments of the methods herein. When processing zirconium material, the ductility of the strip may depend upon the purity of the strip material, the crystallographic texture of the strip material, the grain size of the metallic material, and any combination of these factors. Impurities, such as oxygen, iron, tin, silicon, and carbon, may have negative effects on the ductility of the zirconium strip material. Also, the crystallographic texture of a strip material may have a significant influence on the formability of the strip in operations involving drawing and stretching. In addition, ductility will generally increase as the size of the grain gets smaller. Thus, it is one goal of the present disclosure to develop compositions and methods of producing substantially pure zirconium strip with controlled crystallographic texture and small grain size, such that the zirconium strip made therefrom will have increased ductility and formability when compared to zirconium or zirconium alloy strips made using conventional industrial methods. As used herein, the term "ductility" means the property of a metal which permits it to be shaped, formed, or reduced in cross sectional area without fracture or cracking. As used herein, the term "formability" means the property of a metal which permits it to be formed into specific shapes by application of applied stress, for example during an industrial process such as working, pressing, and hammering, without fracture or cracking.

One non-limiting embodiment of the present disclosure relates to a method for producing a deformable substantially pure zirconium strip. As used herein, the term "deformable" means being capable of undergoing plastic deformation and non-reversible distortion in response to applied stresses. In certain non-limiting embodiments, substantially pure zirconium consists essentially of zirconium. According to other non-limiting embodiments, substantially pure zirconium comprises zirconium and impurities comprising less than 600 parts per million ("ppm") of oxygen, less than 200 ppm of iron. In other non-limiting embodiments, substantially pure zirconium comprises zirconium and impurities comprising less than 600 ppm of oxygen, less than 200 ppm of iron, less than 50 ppm of carbon, less than 50 ppm of silicon, less than 50 ppm of niobium, and less than 100 ppm of tin. The enhanced formability of the substantially pure zirconium of the present disclosure appears to be due, at least in part, to the low levels of impurities found in the strip. For example, the formability of the zirconium decreases when the levels of oxygen and iron increase above 600 ppm and 200 ppm, respectively. However, certain non-limiting embodiments may have desired formability even though the substantially pure zirconium comprises one or more of carbon, silicon, niobium and tin in amounts in excess of the values listed above, provided that the levels of oxygen and iron are less than 600 ppm and 200 ppm, respectively.

According to certain non-limiting embodiments within the present disclosure, a method for producing highly deformable substantially pure zirconium strip comprises heating a substantially pure zirconium article, such as, for example, a billet, an ingot, a slab, a bar, or a plate, within the beta phase temperature region; beta quenching the substantially pure zirconium article; forming a strip from the substantially pure zirconium article by a process comprising hot working the substantially pure zirconium article at a temperature of about 470° C. (878° F.) to about 700° C. (1292° F.); reducing the thickness of the strip by a process comprising a plurality of cold rolling passes with intermediate anneals between successive cold rolling passes, wherein each intermediate anneal includes heating the strip at less than about 490° C. (914° F.) for less than 10 minutes; and final annealing the strip after a final cold rolling pass, wherein the strip is heated at less than 550° C. (1022° F.) for less than 20 minutes.

The step of heating the substantially pure zirconium article within a beta phase temperature region will now be discussed in some detail. Zirconium has a hexagonal close-packed ("hcp") crystal structure at relatively low temperatures, i.e., less than about 862° C. (1584° F.). The "low temperature" hcp crystal structure is known as the α-phase (alpha-phase). The zirconium hcp crystal structure undergoes allotropic transformation to a body-centered cubic ("bcc") crystal structure at temperatures above about 862° C. (1584° F.). This "high temperature" bcc crystal structure is known as the β-phase (beta-phase). As used herein, the term "within a beta phase temperature region" is defined as heating the article in the temperature region in which the zirconium article undergoes transformation from the α-phase (alpha phase) to the β-phase (beta phase). For the substantially pure zirconium of the present disclosure, the beta phase temperature region begins at about 862° C. (1584° F.). Thus, heating the substantially pure zirconium within a beta phase temperature region involves heating the substantially pure zirconium to a temperature greater than or equal to about 862° C. (1584° F.). Heating the substantially pure zirconium article within the beta phase temperature region transforms the crystal structure of the article from hcp (alpha-phase) to bcc (beta-phase). To ensure complete transformation to the beta-phase during heating within the beta-phase temperature region, the article should be heated at temperatures within the beta-phase temperature region for a time sufficient to ensure complete transformation from the alpha-phase to the beta-phase throughout the article, which in certain non-limiting embodiments may be a time greater than 30 seconds.

After the substantially pure zirconium article has been heated within the beta phase temperature region, the article is beta quenched. As is known in the art, beta quenching involves rapid cooling of an article from the beta phase temperature region to a temperature below the beta phase temperature region. An example of beta quenching of the substantially pure zirconium article contemplated by the method of the present disclosure is rapidly cooling the article from a temperature within the beta-phase region to a temperature of less than 860° C. (1580° F.), which is below the beta-phase temperature region, at a cooling rate of at least 1° C./sec (1.8° F./sec). In certain embodiments, the substantially pure zirconium article is beta-quenched at a cooling rate of 3° C./sec (5.4° F./sec) to 1000° C./sec (1800° F./sec). The rapid cooling of the beta quench may be accomplished by, for example, immersing the substantially pure zirconium article in a liquid of lower temperature, such as, for example, water or oil. Cooling of zirconium from the β-phase temperature region to the α-phase temperature region generally results in a Widmanstätten structure in the α-phase zirconium. As used herein, the term "Widmanstätten structure" is defined as a structure characterized by a geometrical pattern resulting from the formation of a new phase (i.e., the α-phase) along certain crystallographic planes of the parent phase (i.e., the β-phase), wherein the orientation of the lattice in the α-phase is related crystallographically to the orientation of the lattice in the β-phase. The β-phase crystal structure of the zirconium article cannot be retained even by rapid quenching. However, the more rapid the cooling rate, such as by beta quenching, the finer the platelets of the Widmanstätten structure. Therefore, beta quenching of the zirconium article generally results in a fine α-phase hcp crystal structure having the random orientation of the crystal grains associated with the β-phase bcc crystal structure.

Orientation of the hcp crystal grains of the substantially pure zirconium article after the beta quench may be represented by the basal pole direction (<0001>) of the hcp crystal (see FIG. 1). As discussed above, the beta quenched substantially pure zirconium article has an essentially random distribution of basal pole orientations of the many hcp crystals. The texture of the zirconium, as defined by the general orientation of the basal poles of the hcp crystals of the article, may influence the ductility/formability of the article. Orientation of the basal poles of the zirconium hcp crystals longitudinally, and more preferably transverse, to the plane of the strip results in a greater degree of ductility/formability than when the basal poles of the hcp crystal are oriented normal to the plane of the strip. Orientation axes of the basal pole direction are presented in FIG. 2*a*. Beta quenching the substantially pure zirconium article redistributes the orientation of the grains so that the fraction of basal poles oriented in the transverse direction is greater than in a zirconium article that has not been beta quenched.

Figure 3:
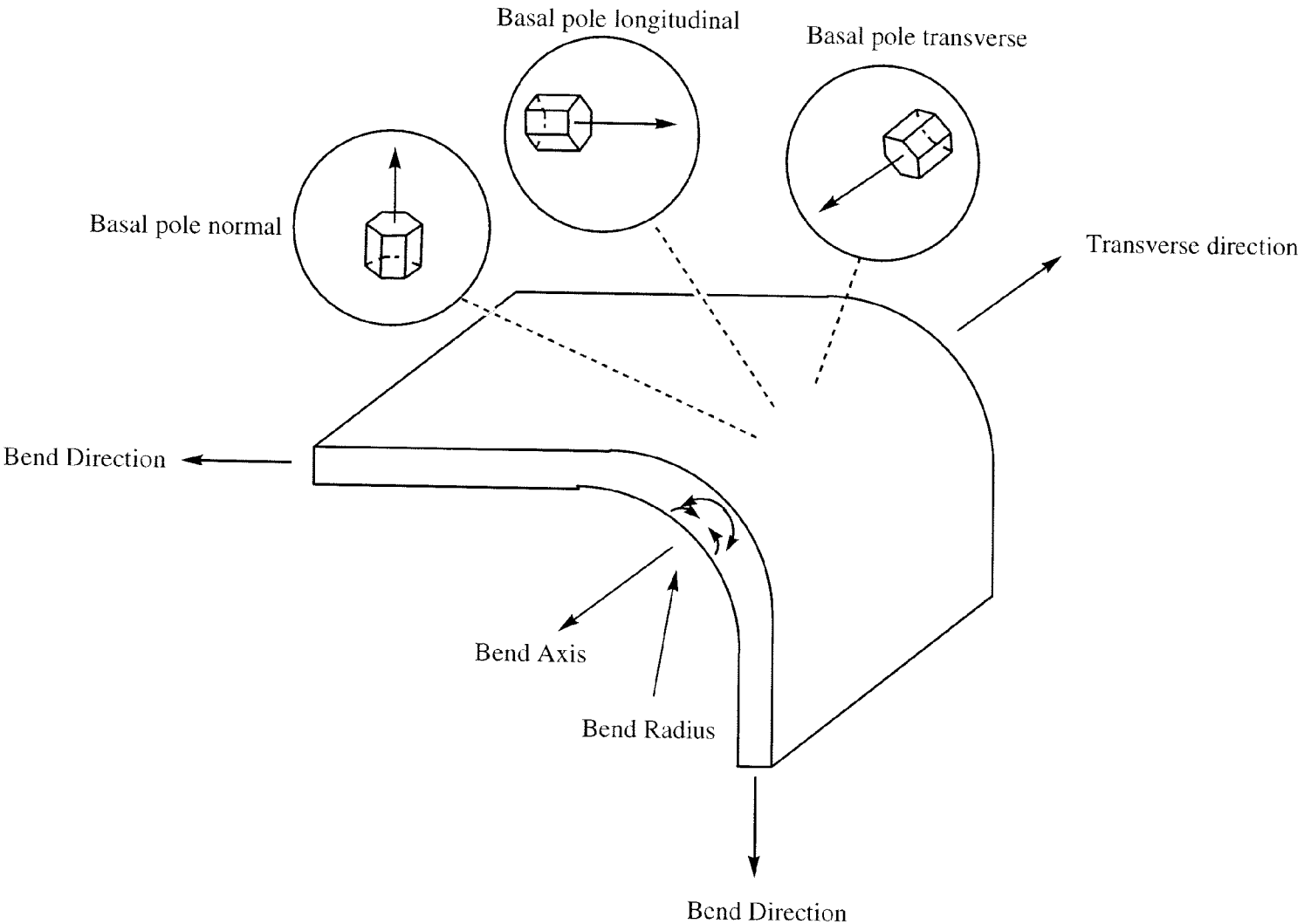
FIG. 3 illustrates the strain state during bending of a zirconium strip material.

More specifically, referring now to FIG. 3, illustrating bending or forming of a strip material, if the material's texture orients the basal poles parallel to the bend direction, ductility is increased to a certain extent and the bend radius can be reduced without cracking. Initial tensile strain along the basal poles is by $\{10\bar{1}2\}$ twinning with a decrease in thickness. The twinned material orients to permit further thinning to occur by compressive $\{11\bar{2}2\}$ twinning (with the basal pole in the radial direction rather than the transverse direction, because no strain is permitted to occur in the transverse direction). The twinned material has the same orientation as the previous texture and will have the same strain state, but appreciable strain has already occurred by the $\{10\bar{1}2\}$ twinning. Thus, the available ductility of the starting texture is increased by the amount of strain produced by the twinning.

If the basal poles are oriented parallel to the bend axis, i.e., oriented transverse to the rolling direction of the strip, all of the strain, tensile in the bend direction and compressive in the radial direction, can be accomplished by slip. The bending forces will be low and the available ductility will be high. Thus, having the basal pole oriented transverse appears to result in the highest ductility.

During conventional thickness compression of the substantially pure zirconium article, such as by hot working or cold working with intermediate anneals, the crystal grains of the zirconium grow and the basal pole axis of many of the hcp crystals reorient to point in the normal direction. This results in a reduction of ductility of the zirconium. According to various non-limiting embodiments of the present disclosure, the inventors have found that by working the substantially pure zirconium under certain conditions, crystal grain growth may be inhibited and reorientation of the basal pole axes of the hcp zirconium crystals may be reduced such that the fraction of basal poles oriented in the normal direction is reduced and the fraction of basal poles oriented in the transverse direction is increased. This results in a substantially pure zirconium strip with smaller grains and wherein the fraction of crystal grains having basal poles oriented in the transverse direction is greater when compared to a zirconium strip processed using conventional thickness compression techniques.

According to various non-limiting embodiments, the method next comprises forming a strip from the substantially pure zirconium article by a process comprising hot working the substantially pure zirconium article at a temperature of about 470° C. (878° F.) to about 700° C. (1292° F.). As used herein, the terms "hot working" or "hot rolling" mean working or rolling the zirconium article at a temperature sufficiently high so that significant strain hardening does not result. Normal processing conditions typically used to produce zirconium strip material involve hot rolling at temperatures greater than about 780° C. (1436° F.). However, hot rolling at these temperatures may result in grain growth and reorientation of crystal basal poles. Thus, according to the various embodiments disclosed herein, the substantially pure zirconium article is hot rolled at or near the lowest practical temperature. In certain embodiments, the hot rolling temperatures are held to less than about 700° C. (1292° F.) and as low as about 450° C. (842° C.). According to certain non-limiting embodiments, the hot rolling temperature is in the range of 470° C. (878° F.) to about 700° C. (1292° F.). In other non-limiting embodiments, the zirconium article is hot rolled at temperatures from about 470° C. (878° F.) to about 700° C. (1292° F.) after preheating the article to 700° C. (1292° F.). Without intending to be limited by any particular theory, it is believed that hot rolling at temperatures from about 450° C. (842°) to about 700° C. (1292° F.) results in smaller hcp crystal grain size while inhibiting reorientation of the basal pole axes of the hcp crystal grains away from the transverse direction and toward the normal direction.

According to the various non-limiting embodiments of the present disclosure, the method next comprises the step of reducing the thickness of the strip by a process comprising a plurality of cold rolling passes with intermediate anneals between successive cold rolling passes, wherein each intermediate anneal includes heating the strip at a temperature of less than about 490° C. (914° F.) for a time period of about 3 minutes to about 10 minutes. According to certain non-limiting embodiments, each intermediate anneal includes heating the strip at a temperature from about 420° C. (788° F.) to about 490° C. (914° F.) for a time period of about 3 minutes to about 10 minutes. In other non-limiting embodiments, each intermediate anneal includes heating the strip at a temperature from about 450° C. (842° F.) to about 490° C. (914° F.) for a time period of about 3 minutes to about 10 minutes. According to the various non-limiting embodiments of the intermediate and final anneals, the strip is heated "at temperature" for the stated length of time using a continuous annealing process. As used herein, "at temperature" means that the metal strip portion being heated has a temperature throughout the thickness of the strip within the cited range for the duration of the cited length of time. Conventional processing conditions commonly used to produce zirconium strip material typically involve cold working with intermediate anneals at temperatures of greater than 780° C. (1438° F.). The conventional annealing process involves batch anneals, where the strip is coiled or rolled and the rolls are heated in a batch furnace. The duration of these conventional intermediate anneals are typically long, ranging from 3 hours to 10 hours or more. The conventional intermediate annealing conditions, alone or combined with hot working at above 780° C. (1436° F.), as discussed above, typically result in a zirconium strip having a grain size smaller than American Society for Testing and Materials ("ASTM") #6 but larger than ASTM #11 (i.e., a grain size number of greater than 6 but less than 11).

According to various non-limiting embodiments of the method, the thickness of the substantially pure zirconium strip is reduced with a plurality of cold rolling passes. As used herein, the term "cold rolling" means reducing the thickness of the material by rolling the material at a temperature below the softening point of the material to create strain hardening (work-hardening). According to certain non-limiting embodiments, the strip is subjected to a number of cold rolling passes sufficient to reduce the strip to a thickness of about 0.5 mm to about 0.8 mm. Each successive cold rolling pass is followed by an intermediate anneal, as described above, before the next cold rolling pass. Each intermediate anneal includes heating the strip at a temperature of less than about 490° C. (914° F.), within the ranges set forth above, for a time period, for example, of about 3 minutes to about 10 minutes. The use of relatively low temperature anneals for short time periods results in a relatively small crystal grain structure and inhibits reorientation of the basal pole axes from the transverse direction to the normal direction, when compared to processes involving intermediate anneals at higher temperatures and/or longer intermediate anneal times.

The methods of the present disclosure next comprise a final annealing of the strip after a final cold rolling pass. During the final anneal, the strip is heated to less than 550° C. (1022° F.) and maintained at that temperature for less than 20 minutes. According to various non-limiting embodiments, the strip is heated "at temperature" during the final annealing for less than 20 minutes. The final annealing may be carried out in a strip (continuous) annealing furnace to limit the time at temperature experienced by the strip. By minimizing the time at temperature in the strip annealing furnace, the time available for grain growth is limited and the zirconium microgram crystal structure remains small. In addition, by minimizing the final annealing time, the reorientation of the basal pole axes from the transverse direction to the normal direction is inhibited.

According to certain non-limiting embodiments of the methods of producing a substantially pure zirconium strip described herein, after the final annealing the strip has a recrystallized microstructure with a grain size smaller than ASTM #11 (i.e., a grain size number of 11 or higher). According to other non-limiting embodiments, after the final annealing the strip has a recrystallized microstructure with a grain size smaller than ASTM #13 (i.e., a grain size number of 13 or higher). The ASTM grain size number directly relates to the number of grains per unit area. Thus, a higher ASTM grain size number corresponds to a larger number of grains per unit area and therefore a smaller or finer grain size.

Figure 2A:
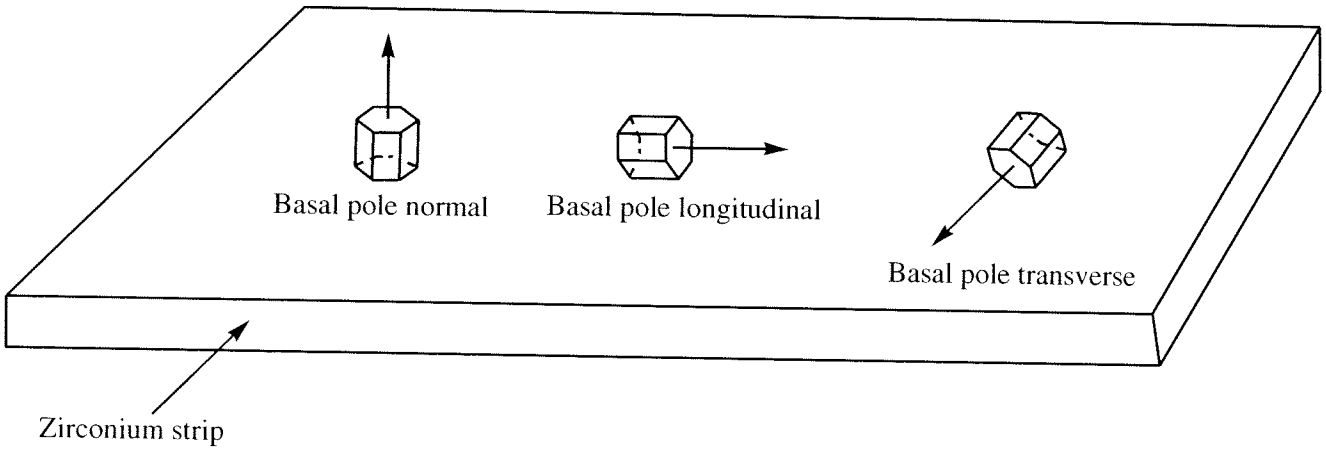
FIG. 2*a* illustrates texture and orientation of zirconium crystal basal poles in a zirconium strip material.
Figure 2B:
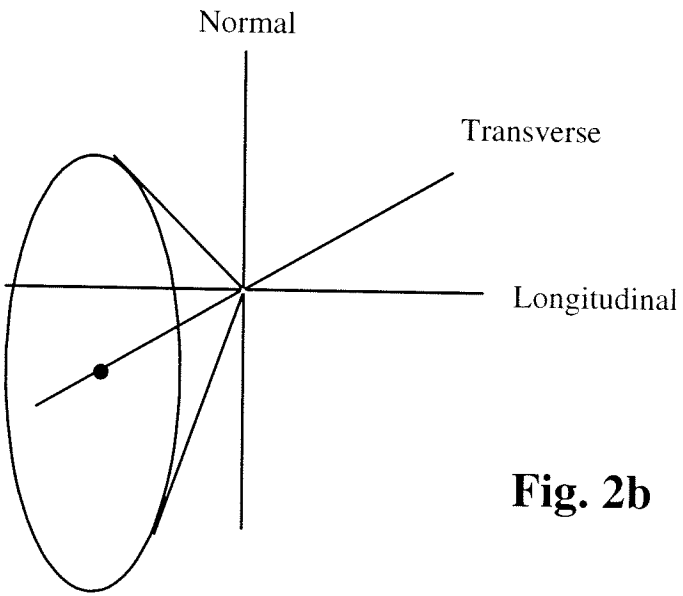
FIG. 2*b* illustrates the region of space defining the direction of the basal pole when oriented in the transverse direction.

The various methods of producing a substantially pure zirconium strip disclosed herein are designed to produce a substantially pure zirconium strip having crystal structure with a higher than typical fraction of basal pole axes of the hcp crystalline lattice oriented in a direction transverse to the strip (see FIG. 2*a*). As used herein, the phrase "basal pole oriented in the transverse direction" means that the basal pole is oriented generally perpendicular to the rolling (longitudinal) direction and the normal direction of the strip, i.e, the basal pole is oriented within a cone defined as within an angular space 45° from the transverse axis as shown in FIG. 2*b*. As disclosed above, ductility and formability of zirconium and its alloys may be dependent, at least in part, upon the crystalline microstructure.

Measuring the orientation of the basal pole axes of the hcp crystal lattice of the substantially pure zirconium strip may be done by x-ray diffraction, neutron diffraction, or ultrasonic measurement. Orientation of the basal pole axes of the crystals is typically reported by the Kearns factors which represent the resolved fraction of basal poles aligned with the three macroscopic directions, i.e., in the normal, longitudinal (rolling direction), and transverse directions; $f_N$, $f_L$, and $f_T$, respectively. (See, Kearns, et al., "Effect of Texture, Grain Size, and Cold Work on the Precipitation of Oriented Hydrides in Zircaloy Tubing and Plate," *Journal of Nuclear Materials*, (1966), 20, 241-261; Anderson, et al., "Ultrasonic Measurement of the Kearns Texture Factors in Zircaloy, Zirconium, and Titanium," *Metallurgical and Materials Trans. A*, (1999), 30A, 1981-1988). According to one non-limiting embodiment, the strip prepared by the various methods disclosed herein has a fraction of basal poles oriented in the transverse direction greater than 0.2 ($f_T>0.2$). According to another non-limiting embodiment, the strip prepared by the various methods disclosed herein has a fraction of basal poles oriented in the transverse direction greater than 0.2 up to 0.4 ($0.2<f_T\leqq 0.4$). According to another non-limiting embodiment, the strip prepared by the various methods disclosed herein has a fraction of basal poles oriented in the transverse direction from 0.23 up to 0.3 ($0.23\leqq f_T\leqq 0.3$). According to a further non-limiting embodiment, the strip prepared by the various methods disclosed herein has a fraction of basal poles oriented in the transverse direction from 0.24 up to 0.3 ($0.24\leqq f_T\leqq 0.3$).

According to certain non-limiting embodiments of the methods of producing a deformable substantially pure zirconium strip disclosed herein, the method further comprises, after final annealing the strip: shaping the strip by one of stamping and hydrostatic forming. Stamping the strip may be performed, for example, using a hydraulic press.

According to certain non-limiting embodiments wherein the method of the present disclosure comprises shaping the strip by stamping, the strip may be shaped by stamping the strip on a hydraulic press with a ram speed controlled to inhibit cracking of the strip. Suitably controlling the ram speed allows the material sufficient time to flow in response to the applied force, such as the applied force of the hydraulic press, thereby inhibiting cracking of the strip material. According to certain non-limiting embodiments, the ram speed may be less than about 0.4 mm/second.

In certain non-limiting embodiments, shaping the strip further comprises lubricating the strip, such as, for example, with at least one of a high-pressure grease and a plastic film. According to these embodiments, the strip is lubricated prior to shaping by stamping or hydrostatic forming. According to the various embodiments wherein the strip is lubricated with a high-pressure grease prior to stamping, the high-pressure grease may comprise a Teflon grease such as, but not limited to, Magnalube® grease (Saunders Enterprises, Inc., Long Island City, N.Y.). According to embodiments wherein shaping the strip comprises lubricating the strip with a plastic film, the film may be, for example, a plastic film comprising one of polyvinyl chloride and polyethylene. The plastic film may be adhered to a surface of the substantially pure zirconium strip that is to be stamped by the press. The plastic film may be of any thickness suitable for providing sufficient lubrication during the stamping process. In certain non-limiting embodiments, the plastic film may have a thickness of about 0.08 mm to about 0.1 mm.

Figures 4A, 4B, 4C:
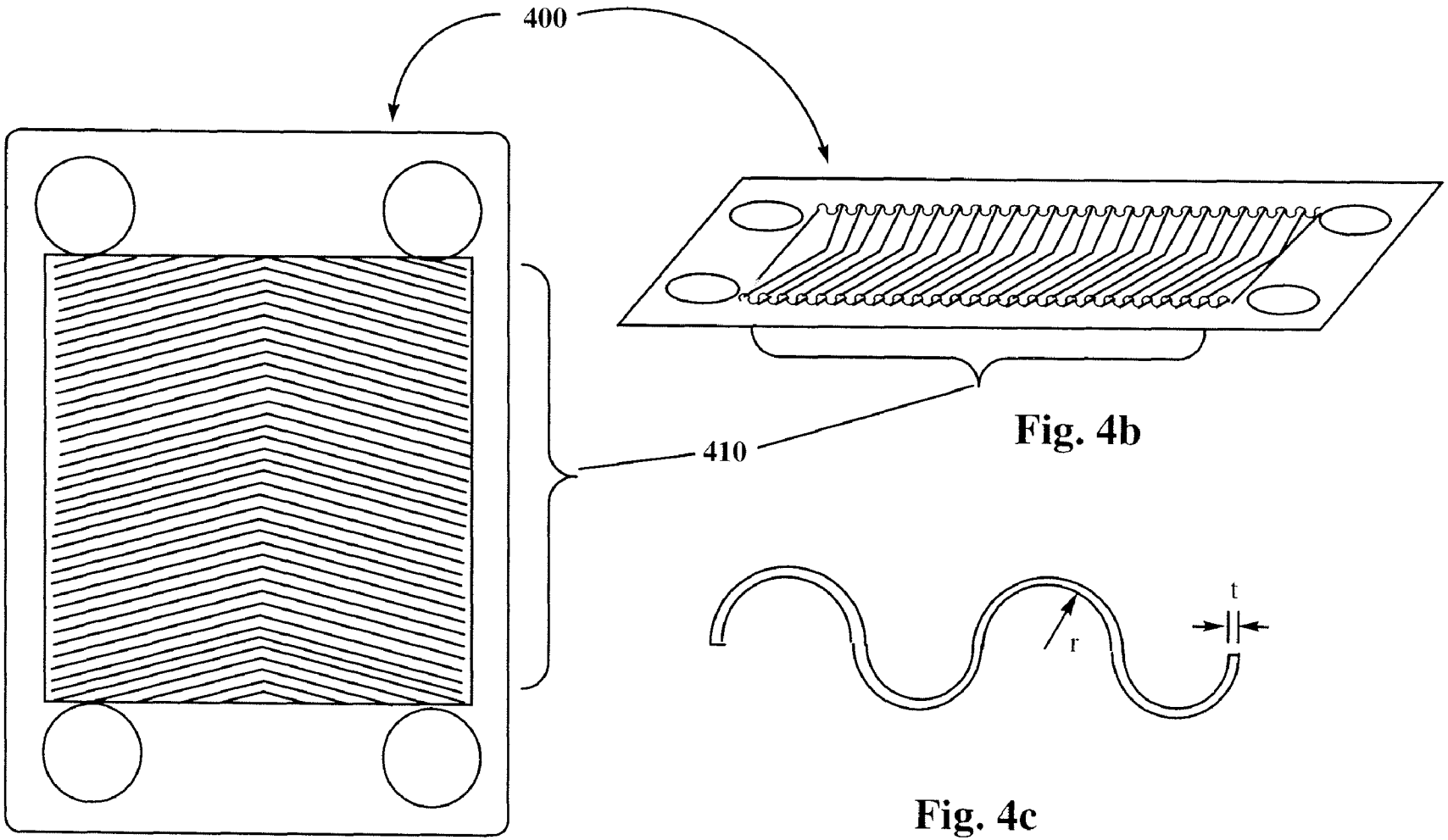
FIGS. 4*a*, 4*b*, and 4*c* illustrate a typical panel for a plate heat exchanger having chevron-shaped corrugations formed thereon.

According to certain non-limiting embodiments, shaping the substantially pure zirconium strip into an article of manufacture comprises forming a plurality of corrugations on the strip. As used herein, the term "corrugation" means a series of ridges and/or depressions in the zirconium strip. The corrugations according to certain non-limiting embodiments may have a depth of about 2 mm to about 8 mm with a bend radius at the peak of the corrugation of 5 to 10 times the thickness of the strip material (i.e., 2.5 mm to 8.0 mm radius for a strip having a thickness of about 0.5 mm to about 0.8 mm). FIG. 4*c* illustrates one embodiment of a corrugation having a bend radium "r" stamped on the substantially pure zirconium strip material having a thickness "t". Thus, according to certain embodiments disclosed herein, the radius r would be equal to from 5t to 10t. In other non-limiting embodiments, the corrugations have a depth of about 4 mm to about 8 mm with a bend radius at the peak of the corrugation of 5 to 10 times the thickness of the strip material. In certain embodiments, the corrugations in the strips are chevron shaped corrugations, although the present disclosure also contemplates corrugations having other shapes. FIGS. 4*a* and 4*b* show one example of a panel 400 for a plate heat exchanger, with a plurality of chevron shaped corrugations 410 impressed therein, produced from a substantially pure zirconium strip according to certain embodiments of the methods of the present disclosure. The corrugations in the zirconium strip, for example, the plurality of chevron shaped corrugations 410, are stamped or pressed into the strip to form the panel from the strip. For example, the corrugations may be formed in the strip using a hydraulic press, preferably advanced into the material at a controlled ram speed. As discussed above, the ram speed may be controlled to inhibit cracking of the strip during the pressing process. In certain non-limiting embodiments, the ram speed is less than about 0.4 mm/sec.

The corrugated substantially pure zirconium strip may then be formed into panels for plate heat exchangers. Plate heat exchangers consist, in part, of pressed, corrugated metal plates which, according to certain non-limiting embodiments disclosed herein, may be formed from the corrugated zirconium strip of the present disclosure. A number of the pressed corrugated metal plates are generally stacked together and fitted in a frame. The number of plates used is determined by the specific heat transfer application. As the individual plates are stacked together, the corrugations on adjacent plates combine to form channels through which liquid or gas can flow. The plate flow channels between adjacent plates are sealed, for example, with a gasket, a weld, or combinations thereof. Fluids or gases may then flow through the channels between adjacent plates, alternating between hot and cold fluids/gases, as described above.

In another non-limiting embodiment according to the present disclosure, a substantially pure zirconium strip produced according to the present disclosure is shaped into a tower packing component. As used herein, the term "tower packing" means a mass of inert shapes packed into a cylindrical column or tower for the purpose of providing greater surface area for the gas and liquid in the column or tower to make contact. Tower packing components may comprise a variety of shapes and generally may be categorized into random packing and structured packing. For random tower packing components, the individual packing components are oriented in a random direction relative to the tower and the other individual packing components. In certain non-limiting embodiments, the zirconium tower packing components manufactured from a substantially pure zirconium strip according to the present disclosure comprise random packing components, such as, but not limited to, saddle rings, rasching rings, and pall-type rings. For structured tower packing components, the packing components are oriented in a structured manner relative to the tower and the other packing components. In other non-limiting embodiments of the present disclosure, zirconium tower packing components manufactured from a substantially pure zirconium strip according to the present disclosure comprise structured packing components, such as but not limited to, corrugated plate tower packing and gauze-type structured packing.

According to another non-limiting embodiment, the present disclosure comprises a method of producing an article of manufacture. The method comprises: heating a substantially pure zirconium article within a beta phase temperature region, the substantially pure zirconium article comprising greater than 99.35% zirconium, less than 600 ppm oxygen, and less than 200 ppm iron (and, optionally, comprising less than 50 ppm carbon, less than 50 ppm silicon, less than 50 ppm niobium, and less than 100 ppm tin); beta quenching the substantially pure zirconium article, for example, by a process comprising immersing the article in a liquid, such as, for example water or oil; forming a strip from the substantially pure zirconium article by a process comprising hot working the article into a substantially pure zirconium strip at a temperature of about 470° C. (878° F.) to about 700° C. (1292° F.); reducing a thickness of the strip to about 0.5 mm to about 0.8 mm by a process comprising a plurality of cold rolling passes with an intermediate anneal between successive cold rolling passes, wherein each intermediate anneal comprises heating the strip "at temperature" at less than about 490° C. (914° F.) for a time of about 3 to about 10 minutes; final annealing the strip after a final cold rolling pass, wherein the strip is heated at less than 550° C. (1022° F.) for less than 20 minutes; and shaping the strip into the article of manufacture by a process comprising shaping the strip on a hydraulic press at a ram speed of less than about 0.4 mm/sec.

According to certain non-limiting embodiments of the method of producing an article of manufacture, shaping the strip comprises lubricating the strip with at least one of a high-pressure grease and a plastic film prior to applying forces to shape the strip. In certain embodiments, shaping the strip comprises lubricating the strip with a high-pressure grease comprising a Teflon grease, such as, for example Magnalube® grease, prior to shaping the strip. According to other embodiments, shaping the strip comprises lubricating the strip with a plastic film, such as a film comprising one of polyvinyl chloride and polyethylene, wherein the plastic film is adhered to the strip, as described above.

According to various non-limiting embodiments of the method of producing an article of manufacture, beta quenching the substantially pure zirconium article redistributes the orientation of the metal grains so that the fraction of basal poles of the hcp crystalline microstructure in the transverse direction is greater than the fraction of basal poles in the transverse direction in an identical zirconium article that has not been beta quenched. The method further comprises forming a strip by a process comprising hot working the article into a substantially pure zirconium strip at a temperature of about 470° C. (878° F.) to about 700° C. (1292° F.); reducing a thickness of the strip to about 0.5 mm to about 0.8 mm by a process comprising a plurality of cold rolling passes with intermediate annealing steps between successive cold rolling passes, wherein each intermediate anneal includes heating the strip "at temperature" at less than about 490° C. (914° F.) for a time of about 3 minutes to about 10 minutes; and final annealing the strip after a final cold rolling pass, wherein the strip is heated "at temperature" at less than 550° C. (1022° F.) for less than 20 minutes. The parameters of the hot working, the intermediate anneals and/or the final anneal are selected so that the fraction of basal poles oriented in the transverse direction is increased and greater than the fraction of basal poles oriented in the transverse direction in an identical zirconium strip material that has been hot worked, intermediate annealed and/or final annealed at a higher temperature range and/or for longer intermediate and/or final annealing times. In addition, as a result of the method of forming the substantially pure zirconium strip, the grain size in the strip remains small. For example, according to certain embodiments, after final annealing the strip has a recrystallized microstructure with a grain size smaller than ASTM #11 (i.e., a grain size number of 11 or higher). According to other embodiments, after final annealing the strip has a recrystallized microstructure with a grain size smaller than ASTM #13 (i.e., a grain size number of 13 or higher).

As discussed above, when a zirconium strip material is heated or annealed at relatively high temperatures and/or for extended periods of time (for example, for times greater than 20 minutes) the crystalline grain structure and crystallographic texture of the zirconium metal may change. For example, under high hot working and/or annealing temperatures, such as those commonly used in the art, the grains may grow such that the recrystallized microstructure of the resulting zirconium strip has a coarser (larger) grain size than ASTM #11 (i.e., a grain size with a lower ASTM number). In addition, hot working at high temperature and/or cold rolling with intermediate and final anneals of high temperature and/or long annealing times may allow the crystalline microstructure of the zirconium strip to transform such that a significant fraction of the basal poles reorient from the transverse direction toward the normal direction. This necessarily reduces the fraction of basal poles in the transverse direction. As discussed above, the ductility and formability of the zirconium strip may be increased by maintaining a small grain size and/or high fraction of basal poles oriented in the transverse direction. Thus, an article of manufacture produced according to the methods described herein will have higher ductility and/or formability than an article of manufacture produced according to a method incorporating higher forging and/or annealing temperatures and/or longer anneal times.

According to certain non-limiting embodiments of the method of producing an article of manufacture, the strip has a fraction of basal poles oriented in the transverse direction greater than 0.2. According to other non-limiting embodiments, the fraction of basal poles oriented in the transverse direction is greater than 0.2 up to 0.4. In other non-limiting embodiments, the fraction of basal poles oriented in the transverse direction is greater than 0.23 up to 0.3. In still other non-limiting embodiments, the fraction of basal poles oriented in the transverse direction is greater than 0.24 up to 0.3.

According to certain non-limiting embodiments of the method of producing an article of manufacture, the article of manufacture may be a component of a heat exchanger. In certain embodiments, for example, the article may be a panel for a heat exchanger, which may be a plate heat exchanger. As discussed above, when the article is a panel for a plate heat exchanger, the heat exchanger panel may comprise a plurality of corrugations having a depth of, for example, about 2 mm to about 8 mm with a bend radius at the peak of the corrugation of, for example, 5 to 10 times the thickness of the strip material (i.e., 2.5 mm to 8.0 mm radius). In other embodiments, the heat exchanger panel may comprise a plurality of corrugations having a depth of, for example, about 4 mm to about 8 mm with a bend radius at the peak of the corrugation of, for example, 5 to 10 times the thickness of the strip material. The corrugations are formed on the substantially pure zirconium strip during the shaping step of the method, where the strip is shaped, for example, on a hydraulic press at a ram speed of less than about 0.4 mm/sec. Without intending to be bound by any particular theory, it is believed that the use of substantially pure zirconium, as described above, and/or the unique processing method, including beta quenching, hot working at temperatures of about 470° C. (878° F.) to about 700° C. (1292° F.), and cold working with intermediate anneals and a final anneal wherein the anneal temperatures are relatively low and anneal times are relatively brief, as set forth above, result in a readily deformable substantially pure zirconium strip that may be formed into an article of manufacture under the conditions discussed above without cracking.

According to other non-limiting embodiments, the article of manufacture may be a tower packing component, as described above. In certain embodiments, the article of manufacture may be a random tower packing component, such as, for example, a saddle ring, a rasching ring, or a pall-type ring. According to other embodiments, the article of manufacture may be a structured tower packing component, such as a metal corrugated plate tower packing component, or a gauze-type structured tower packing component. The tower packing component may be formed from the substantially pure zirconium strip during the shaping step of the methods described herein. The methods result in a deformable substantially pure zirconium strip that may be formed into the various tower packing components without cracking. Due to the corrosion resistant properties of the substantially pure zirconium strip material, the tower packing components made therefrom will exhibit long service lifetimes when compared to tower packing components made from certain other alloys.

According to other non-limiting embodiments, the present disclosure also contemplates articles of manufacture comprising a formed strip of substantially pure zirconium including zirconium and impurities of less than 600 ppm oxygen and less than 200 ppm iron. In certain embodiments, the formed strip may comprise zirconium and impurities of less than 600 ppm oxygen, less than 200 ppm iron, less than 50 ppm carbon, less than 50 ppm silicon, less than 50 ppm niobium and less than 100 ppm tin. The articles of manufacture may be made by any of the methods described herein for manufacturing a substantially pure zirconium strip or article of manufacture. The formed strip may have a grain structure and texture that allows the strip to be readily shaped or formed into an article of manufacture having a complex shape or surface structure. For example, the article of manufacture may be a panel for a plate heat exchanger having a plurality of corrugations impressed onto the strip, such as, for example, chevron shaped corrugations, wherein the corrugations have, for example, a depth of from 2 mm to about 8 mm with a bend radius at the peak of the corrugation of 5 to 10 times the thickness of the strip material. In certain embodiments, the corrugations have a depth of about 4 mm to about 8 mm with a bend radius at the peak of the corrugation of 5 to 10 times the thickness of the strip material. Alternatively, the article of manufacture may be a tower packing component, such as a random tower packing component or structured tower packing component, as described above.

In certain embodiments of the article of manufacture, the formed strip has a crystallographic texture with a fraction of basal poles oriented in the transverse direction greater than 0.2. In other embodiments, the fraction of basal poles oriented in the transverse direction is greater than 0.2 up to 0.4. In still other embodiments, the fraction of basal poles oriented in the transverse direction is from 0.23 up to 0.3. In further embodiments, the fraction of basal poles oriented in the transverse direction is from 0.24 up to 0.3. As a result of the method of manufacture, the formed strip may have a recrystallized microstructure with a grain size smaller than ASTM #11 (i.e., a grain size number of 11 or higher). In certain embodiments, the formed strip has a recrystallized microstructure with a grain size smaller than ASTM #13 (i.e., a grain size number of 13 or higher).

The article of manufacture may be any of the articles of manufacture discussed above, for example, plate heat exchanger panels and tower packing components. The articles of manufacture may be, but are not limited to, articles requiring properties, such as corrosion resistance properties, associated with the substantially pure zirconium used in the strip of the present disclosure. In addition, the articles are shaped or formed from a substantially pure zirconium strip which may be made by the any of the various methods disclosed herein.

The present disclosure also contemplates a formed substantially pure zirconium strip including zirconium and impurities of less than 600 ppm oxygen and less than 200 ppm iron. Certain embodiments of the formed zirconium strip may include zirconium and impurities of less than 600 ppm oxygen, less than 200 ppm iron, less than 50 ppm carbon, less than 50 ppm silicon, less than 50 ppm niobium and less than 100 ppm tin. According to certain embodiments, the formed strip comprises a crystallographic texture with a fraction of basal poles oriented in the transverse direction greater than 0.2. In other embodiments, the fraction of basal poles oriented in the transverse direction is greater than 0.2 up to 0.4. In still other embodiments, the fraction of basal poles oriented in the transverse direction is from 0.23 up to 0.3. In further embodiments, the fraction of basal poles oriented in the transverse direction is from 0.24 up to 0.3. As a result of the method of manufacture, the formed strip may have a recrystallized microstructure with a grain size smaller than ASTM #11 (i.e., a grain size number of 11 or higher). In certain embodiments, the formed strip has a recrystallized microstructure with a grain size smaller than ASTM #13 (i.e., a grain size number of 13 or higher).

One non-limiting embodiments of the present disclosure is illustrated in the following non-limiting example. Those having ordinary skill in the relevant art will appreciate that various changes in the components, compositions, details, material and process parameters of the example that are hereafter described and illustrated in order to explain the nature of the invention may be made by those skilled in the art, and all such modifications will remain within the principle and scope of the invention as expressed herein and in the appended claims. It will also be appreciated by those skilled in the art that changes could be made to the embodiments described above and below without departing from the broad inventive concept thereof. It is understood therefore, that this invention is not limited to the particular embodiment disclosed, but is intended to cover modifications that are within the principle and scope of the invention, as defined by the claims.

A substantially pure zirconium strip was made according to one of the non-limiting embodiments disclosed herein as follows. A zirconium ingot comprising about 400 ppm oxygen, about 110 ppm iron, about 30 ppm carbon, less than 10 ppm silicon, less than 50 ppm niobium and less than 10 ppm tin, was preheated at 772° C. (1422° F.) and forged to a slab having a width of 22 inches and a thickness of 4 inches. The slab was heated at a temperature within the range of 920° C. (1688° F.) to 1000° C. (1832° F.) for 20 minutes, and then beta quenched by submersion in water. The slab was then conditioned to remove any surface oxide by a sandblasting, grinding, and acid pickling process. The slab was then heated to a temperature of 700° C. (1292° F.) and hot rolled to yield a 3.2 mm thick strip. The hot rolled product was conditioned by shot-blasting and pickling to remove the oxide coating and the edges were trimmed.

The strip was cold rolled in a first cold rolling pass to a thickness of 2 mm and annealed by continuous strip annealing at 460° C. (860° F.) for 6 minutes at temperature. The strip was conditioned for cold rolling by shot-blasting and acid pickling, then cold rolled in a second cold rolling pass to a thickness of 1 mm. The strip was annealed by continuous strip annealing at 460° C. (860° F.) for 6 minutes at temperature. The strip was cold rolled in a final cold rolling pass to a thickness of 0.51 mm and then annealed by continuous strip annealing at 520° C. (968° F.) for 8 minutes at temperature. The zirconium strip was sheared into pieces having the appropriate dimensions for press forming into heat exchanger panels.

The substantially pure zirconium strip material had a recrystallized microstructure with a grain size of ASTM #13. The strip was subjected to mechanical testing to determine the elongation strength, tensile strength and percent elongation in both the transverse and longitudinal directions. The results are presented in Table 1.

TABLE 1

Mechanical Properties of Zirconium Strip Material

| Transverse Direction | | | Longitudinal Direction | | |
|---|---|---|---|---|---|
| Yield Strength (kpsi) | Tensile Strength (kpsi) | Elongation % | Yield Strength (kpsi) | Tensile Strength (kpsi) | Elongation % |
| 56.0 | 56.6 | 20 | 45.3 | 57.3 | 38 |
| 56.5 | 58.2 | 19 | 45.4 | 57.4 | 38 |
| 55.6 | 57.9 | 20 | | | |

The strip was subjected to a 180° bend in both the transverse and longitudinal directions. In both the transverse and longitudinal direction the strip material did not crack upon bending to 1T radius. The strip material according to this Example was formed into a panel for a plate heat exchanger using a hydraulic press with a ram speed of 0.4 mm/sec after applying a 0.1 mm thick plastic film to the strip surface for lubrication. The resulting panel had chevron shaped corrugations that were 4.3 mm deep, with a spacing of 12.7 mm, and a 3.8 mm radius at the peak of the corrugation. No cracking was observed in the corrugated panel.

I claim:

1. An article of manufacture comprising:

a formed strip of a material consisting essentially of zirconium, hafnium, less than 600 ppm oxygen, and less than 200 ppm iron;

wherein the formed strip includes a crystallographic texture including a fraction of basal poles in a transverse direction greater than 0.2; and wherein the formed strip includes a recrystallized microstructure including a grain size smaller than ASTM #11.

2. The article of claim 1, wherein the material consists essentially of zirconium, hafnium, less than 600 ppm oxygen, less than 200 ppm iron, less than 50 ppm carbon, less than 50 ppm silicon, less than 50 ppm niobium, and less than 100 ppm tin.

3. The article of claim 1, wherein the formed strip includes a crystallographic texture including a fraction of basal poles in a transverse direction greater than 0.2 up to 0.4.

4. The article of claim 1, wherein the formed strip includes a crystallographic texture including a fraction of basal poles in a transverse direction from 0.23 up to 0.3.

5. The article of claim 1, wherein the formed strip includes a recrystallized microstructure including a grain size smaller than ASTM #13.

6. The article of claim 1, wherein the article is a heat exchanger panel.

7. The article of claim 6, wherein the heat exchanger panel comprises at least one formed strip according to claim 1, wherein the formed strip comprises a plurality of corrugations having a depth of 2 mm to 8 mm.

8. The article of claim 7, wherein each of the plurality of corrugations includes a bend radius at the peak of the corrugation of 5 to 10 times the thickness of the strip.

9. The article of claim 7, wherein the plurality of corrugations are chevron-shaped corrugations.

10. The article of claim 1, wherein the article is a tower packing component.

11. The article of claim 10, wherein the tower packing component is a random tower packing component selected from the group consisting of a saddle ring, a rasching ring, and a pall-type ring.

12. The article of claim 10, wherein the tower packing component is a structured packing component selected from the group consisting of a corrugated plate tower packing component and a gauze-type structured tower packing component.

13. A formed zirconium strip consisting essentially of zirconium, hafnium, less than 600 ppm oxygen, less than 200 ppm iron, less than 50 ppm carbon, less than 50 ppm silicon, less than 50 ppm niobium, and less than 100 ppm tin;

wherein the strip includes a fraction of basal poles in a transverse direction greater than 0.2; and wherein the strip includes a recrystallized microstructure with a grain size smaller than ASTM #11.

14. The formed zirconium strip of claim 13, wherein the strip includes a fraction of basal poles in a transverse direction greater than 0.2 up to 0.4.

15. The formed zirconium strip of claim 13, wherein the strip includes a fraction of basal poles in a transverse direction from 0.23 up to 0.3.

16. The formed zirconium strip of claim 13, wherein the strip includes a recrystallized microstructure with a grain size smaller than ASTM #13.

* * * * *